United States Patent [19]

McInerney

[11] Patent Number: 4,621,592

[45] Date of Patent: Nov. 11, 1986

[54] BOILER HAVING IMPROVED HEAT ABSORPTION

[75] Inventor: Michael J. McInerney, Highland Park, Ill.

[73] Assignee: Vapor Corporation, Chicago, Ill.

[21] Appl. No.: 676,012

[22] Filed: Nov. 29, 1984

[51] Int. Cl.[4] ..... F22B 21/26

[52] U.S. Cl. ..... 122/250 R; 122/18; 122/169; 165/156; 165/163

[58] Field of Search ..... 122/18, 20 B, 160, 166 R, 122/169, 185, 244, 247, 249, 250 R, 258, 420, 421, 448 S; 165/156, 163

[56] References Cited

U.S. PATENT DOCUMENTS

| | | | |
|---|---|---|---|
| 531,756 | 1/1895 | Whitlock et al. | 122/249 |
| 1,469,805 | 10/1923 | Musselman | 122/250 R |
| 2,160,644 | 5/1939 | Clarkson | 122/250 R |
| 2,735,410 | 2/1956 | Armbrust et al. | 122/448 S |
| 3,720,259 | 3/1973 | Fritz et al. | 165/163 |
| 3,788,281 | 1/1974 | Champagne | 165/163 X |
| 4,442,799 | 4/1984 | Craig et al. | 165/163 X |

FOREIGN PATENT DOCUMENTS

| | | | |
|---|---|---|---|
| 560910 | 4/1944 | United Kingdom | 122/249 |

*Primary Examiner*—Albert J. Makay
*Assistant Examiner*—Steven E. Warner
*Attorney, Agent, or Firm*—Francis J. Lidd

[57] ABSTRACT

A flash boiler or steam generator includes a shell defining a combustion chamber. A coil bank is mounted adjacent to the combustion chamber and includes an inner coil defining a heat absorption chamber. An intermediate coil is positioned in the chamber surrounding the inner coil. An outer coil surrounds the intermediate coil. The outer coil is in serial communication with a source of fluid and with the inner coil. The inner coil is in serial communication with the intermediate coil and the intermediate coil communicates with an outlet. To limit pressure drop through and increase heat transfer by the coils, the diameter of the inner coil is larger than the diameter of the outer coil and the diameter of the intermediate coil is larger than the diameter of the inner coil. To further increase the heat absorption efficiency of the coil bank, an extended surface is defined on at least a portion of the outer coil. The extended surface is of helical thread configuration and of a predetermined width and pitch to allow the surfaces to rest on each other once the coils are wound around the combustion chamber.

8 Claims, 10 Drawing Figures

40
36
38
42
54
52
50
56
58
46
48
34
44
28
1900
1500
1000
500
200
TEMPERATURE (°F)
INNER COIL
INTERMED COIL
OUTER COIL
0
20
40
60
80
100
120
INTERNAL HEATING SURFACE (SQ FT.)

BOILER HAVING IMPROVED HEAT ABSORPTION

BACKGROUND OF THE INVENTION

1. Field of the Invention

The present invention relates to a new and improved heat exchange system for a flash boiler or steam generator and to a method for improving the efficiency and heat recovery of a flash boiler; and, more particularly, to a new and improved coil bank for a steam generator.

2. Description of the Background Art

Typically, steam generators or flash boilers of the type illustrated in U.S. Pat. No. 2,735,410 hereby incorporated by reference and include generating systems and coil banks of the type illustrated in U.S. Pat. No. 2,160,644, also incorporated by reference. These systems and coil banks operate on the assumption that the coldest fluid being heated should be in contact with the hottest flue gas. These units use "straight through" coil flow to generate steam from a group of serial connected helical coils that define a heat exchanger. Water under pressure is introduced at one end of one coil, heated throughout the length of the interconnected coils and delivered as steam at the outlet. These systems and coil banks are generally designated "counter flow" units in that water at low temperature is introduced in the coil farthest from the source of heat energy at the point where combustion gases are at the lowest temperature.

To force fluid through the heat exchanger, a pressure source is necessary. The pressure source must be of a pressure equal to the steam outlet pressure plus the pressure drop in the heat exchanger. Pressure drop in the heat exchanger is substantial since resistance to flow during fluid phase change is high.

Due to the very large and variable heat absorption of fluid in phase change or boiling, actual temperature profiles of these heat exchangers demonstrate that with the present coil system, the highest fluid temperature occurs near the center of the flow path through the coils. Fluid temperature then drops as the fluid in phase change absorbs more heat. Fluid temperature is highest at this point because the fluid is heated without phase change. As fluid saturation temperature is reached, fluid temperature drops due to boiling. In the present heat exchanger, the point of highest fluid temperature establishes a fluid temperature distribution such that the mean fluid temperature is relatively low in relation to the flue gas heat source. This reduces the efficiency of the heat exchanger.

Further, diameters of these heat exchangers are not matched to fluid boiling locations. Since steam is of a significantly larger volume than liquid, the poor cross sectional match exacerbates pressure drop through the coils.

In heat exchangers of this type, the coils are wound in a counter helix configuration and held together by a supporting structure including block and sinuous spacers to define open spaces for gas flow around the coils. An example of this structure is illustrated in U.S. Pat. No. 3,720,259. For these coils, due to the reduction in flue gas temperature, the heat absorption capability of the outer layers is less than the inside layers. It is desirable to increase the absorption capability of the outside of the coils without increasing the space taken by the coils and not appreciably increasing flue gas pressure drop around the coils. Extended surfaces on the coils have been attempted but these surfaces tend to interlock obstructing the spaces between the coils. However, the structure disclosed provides extended surfaces which do not interlock.

SUMMARY OF THE INVENTION

An object of the present invention is to provide a new and improved heat exchanger for a flash boiler.

Another object of the present invention is to provide a new and improved method of increasing the efficiency of a heat exchanger in a flash boiler.

A further object of the present invention is to provide a coil system for a steam generator of varying diameters matched to heat absorption to reduce pressure drop through the coil.

A still further object of the present invention is to provide a coil for a flash boiler with an extended surface to increase heat absorption.

Another object of the present invention is to arrange flow through coils of a flash boiler to place the fluid of the highest temperature near flue gas of the highest temperature.

Briefly, the present invention is directed to a new and improved heat exchanger for flash boilers and to a method for improving the efficiency of the heat exchanger. In the present invention an inner coil is wound around a combustion gas plenum chamber of the flash boiler. An intermediate coil surrounds the inner coil and an outer coil surrounds the intermediate coil. Fluid such as water is introduced in the outer coil. The outer coil is in serial communication with the inner coil which is in serial communication with the intermediate coil. The intermediate coil is in communication with the coil system outlet. As the inner coil is exposed to the maximum flue gas temperatures which decrease progressively on passing through the intermediate and outer coils, the disclosed coil connection located coil fluid temperature so as to maximize the flue gas, coil fluid temperature distribution. Applicant has discovered that the disclosed coil connections provide increased heat absorption through rerouting of existing fluid flows.

To reduce pressure drop in the coils, the inner coil is of a larger diameter than the diameter of the outer coil and the diameter of the intermediate coil is larger than the diameter of the inner coil.

The heat absorption capability of the coils is further enhanced by a fin or extension on the outer surface of the coils. The fin is in the configuration of a helical thread and of a size and pitch to avoid interlocking of fins in the helical configuration.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DESCRIPTION OF THE PREFERRED EMBODIMENT

Figures 1, 1A:
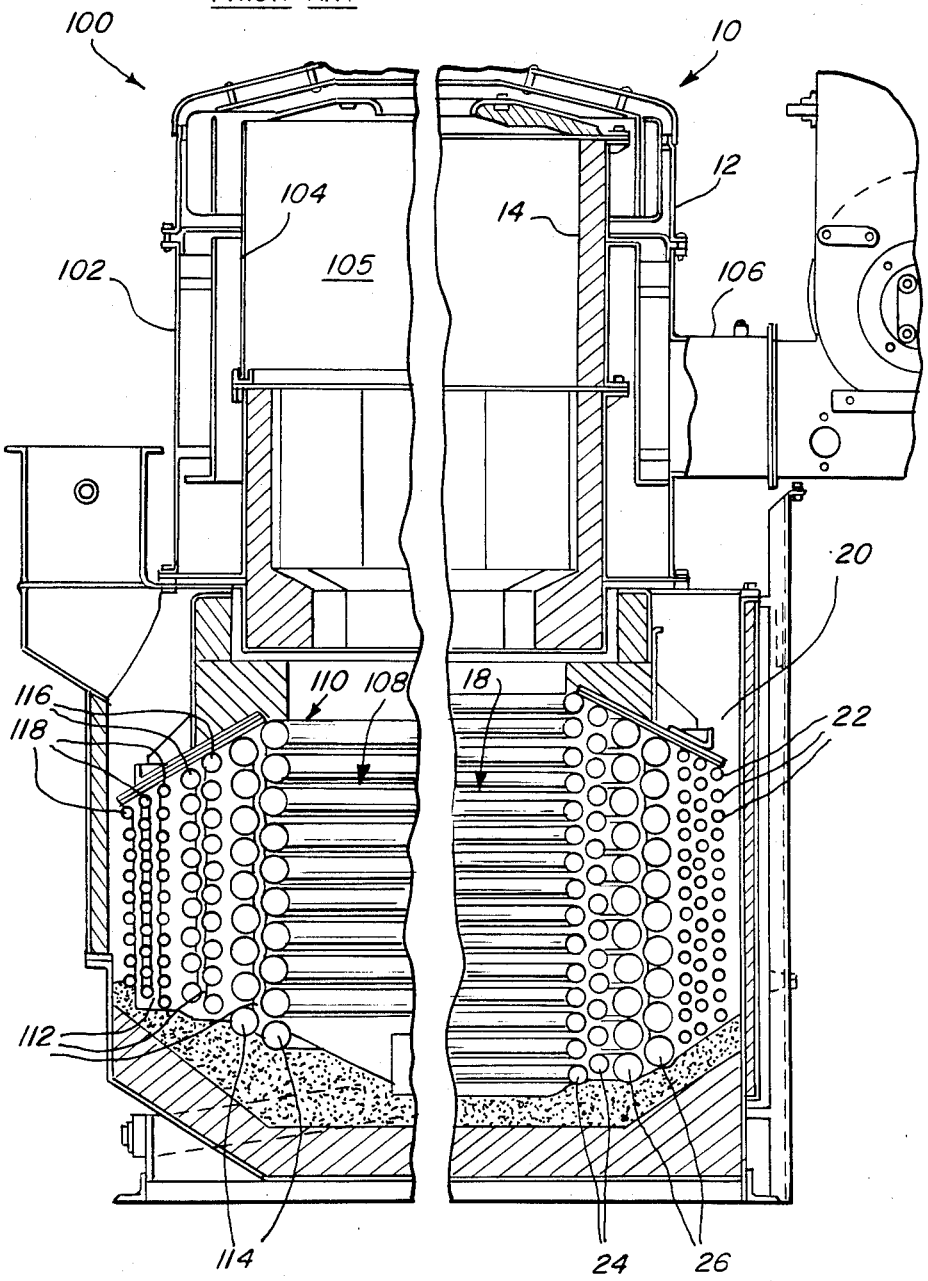
FIG. 1 PRIOR ART
FIG. 1 is a vertical cross sectional view of a steam generator illustrating the left hand portion of a prior art coil bank configuration.
FIG. 1*a* is a vertical cross-sectional view of the right hand portion of the coil bank or heat exchanger configuration of the coil bank or heat exchanger configuration of the present invention.
Figure 2:
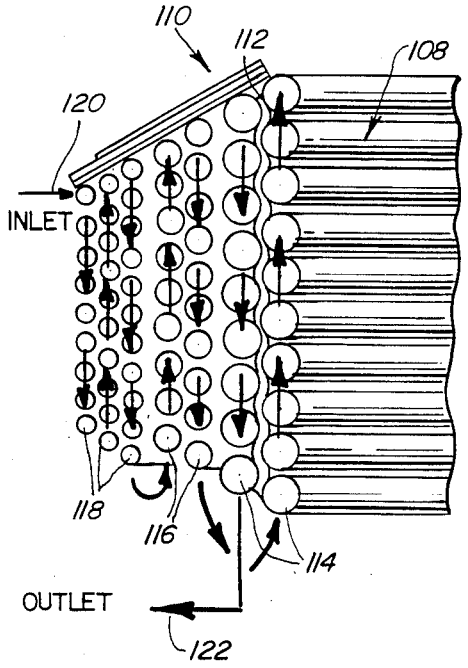
FIG. 2 PRIOR ART
FIG. 2 is a vertical cross sectional view of the left hand of the prior art coil bank, illustrating the flow scheme therethrough.
Figure 2A:
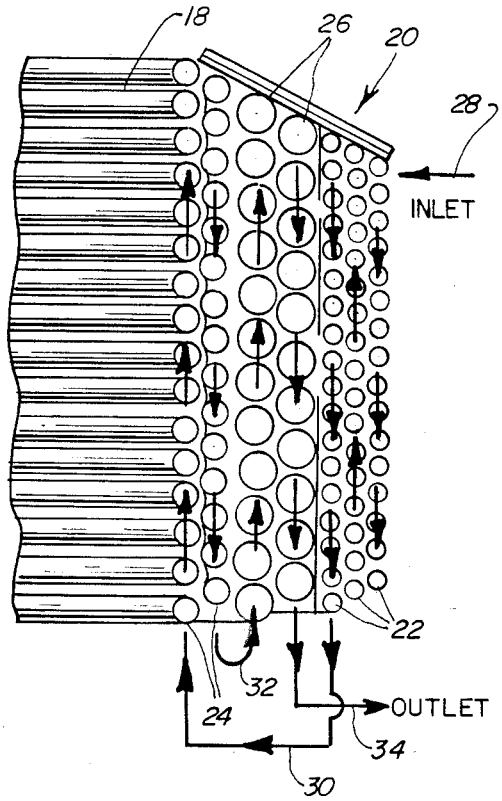
FIG. 2*a* is a vertical cross section of a steam generator right hand portion illustrating the flow scheme through the coil bank constructed in accordance with the principles of the present invention.

Referring initially to FIGS. 1, 1*a*, 2, 2*a*, and 6, there is illustrated in FIGS. 1*a* and 2*a* a prior art steam generator or boiler 100 known as a counter flow type of system. The counter flow system 100 is a vertically fired boiler with a housing 102.

The boiler 100 includes a fire pot 104 at the upper end within which a burner and ignition device (not shown) may be mounted. Fire pot 104 also defines a combustion chamber 105. An air duct 106 introduces air into the combustion chamber or fire pot 104 to mix with fuel for combustion. Hot flue gases flow into the center of a heating chamber 108 surrounded by a heat exchanger or coil bank generally designated by the reference numeral 110.

Heat exchanger 110 includes a plurality of coils wound about each other and spaced slightly apart by sinusoidal spacers 112 and block spacers 113 to allow flue gases to pass between adjacent coils exchanging heat from the gas to the coils. Heat exchanger 110 includes a plurality of inner coils 114 surrounded by a plurality of intermediate coils 116. Intermediate coils 116 are surrounded by a plurality of outer coils 118. Inner coils 114 are of a larger diameter than intermediate coils 116 and intermediate coils 116 are of a larger diameter than the outer coils 118.

The flow of water to be heated in heat exchanger or coil bank 110 is illustrated in the left hand portion of FIG. 2. As illustrated by arrows, flow is introduced at an inlet 120 and circulates through the outer coils 118 then through intermediate coils 116 and finally through inner coils 114 to an outlet 122.

Figure 6:
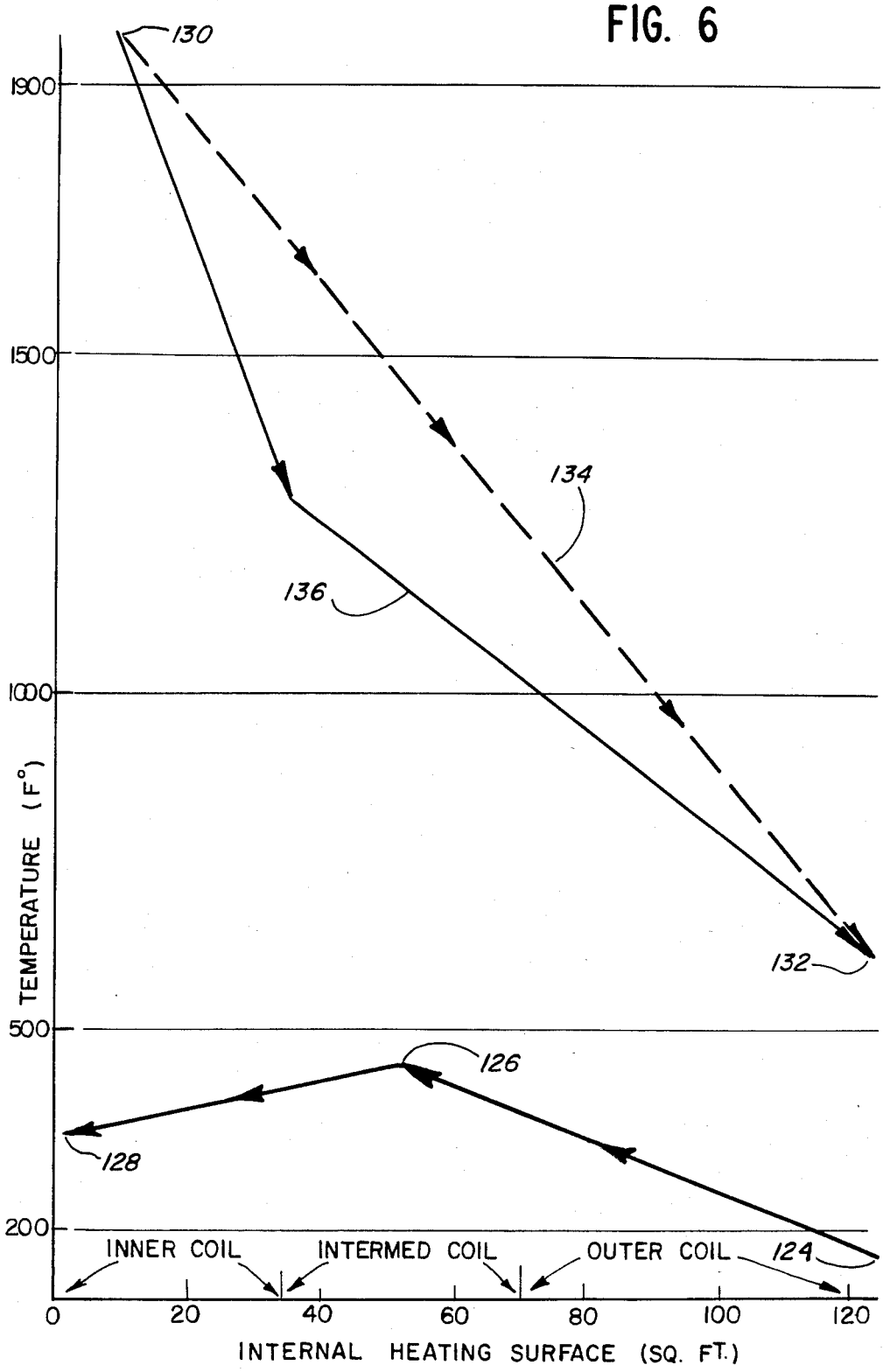
FIG. 6 is a graph illustrating the relationship of ideal flue gas temperature relative to actual flue gas temperature and internal coil fluid temperature in a typical boiler utilizing a present coil system.

In the lower portion of FIG. 6 the actual temperature profile of fluid through the counter flow boiler 100 and specifically the heat exchanger 110 is plotted. As plotted, water is introduced at a cold temperature illustrated at point 124. This temperature occurs at the inlet 120 of outer coil 118. As fluid flows through outer coil 118 and part of intermediate coil 116 water temperature rises to the maximum temperature illustrated at point 126 on the graph in FIG. 6. After point 126, the temperature of the fluid drops to the outlet temperature illustrated at point 128 on the graph. Point 126 corresponds to the phase change of the water and the temperature drop after point 126 is due to the heat of vaporization absorbing heat.

In the upper portion of FIG. 6, ideal flue gas temperature is plotted with the maximum temperature at point 130 and the lowest temperature at point 132 which is the gas temperature as it is exhausted through the stack of boiler 100. The line plotting the ideal flue gas temperature distribution is designated by the reference numeral 134. Also plotted in the upper portion of FIG. 6 is a solid line 136 plotting actual flue gas temperature for the counter flow boiler 100. As illustrated in the upper portion of FIG. 6, heat absorption from flue gas in the prior counter flow boiler 100 (reference FIG. 2) departs significantly from the ideal flue gas temperature line 134 indicating significantly less efficient operation than under ideal circumstances.

Returning to FIGS. 1*a* and 2*a*, there is illustrated on each of these FIGS. a boiler 10 constructed in accordance with the principles of the present invention. Boiler 10 includes a housing 12 and a fire pot 14 similar to the corresponding components in the counter flow boiler 100. Boiler 10 also employs the air duct 106. Flue gases enter a combustion area 18 defined within coil bank or heat exchanger 20.

Coil bank 20 includes a plurality of coils wound in a substantially helical manner. Specifically, coil bank 20 includes outer coils 22, inner coils 24, and intermediate coils 26. Outer coils 22 are of the smallest diameter with increasing diameters in the inner coils 24 and the largest diameter being the intermediate coils 26.

Referring to the right hand portion of FIG. 2, flow of fluid such as water through coils 22, 24, and 26 is illustrated. Cold water is introduced by inlet 28 to outer coils 22. Once fluid flows through outer coils 22 in accordance with the arrows in FIG. 2, water is communicated by a conduit 30 or similar structure to inner coils 24. Water flows through the inner coils 24 as indicated by the arrows and is directed by a conduit 32 or similar structure to intermediate coils 26. From intermediate coils 26, the fluid, now steam, passes through an outlet 34.

Figure 3:
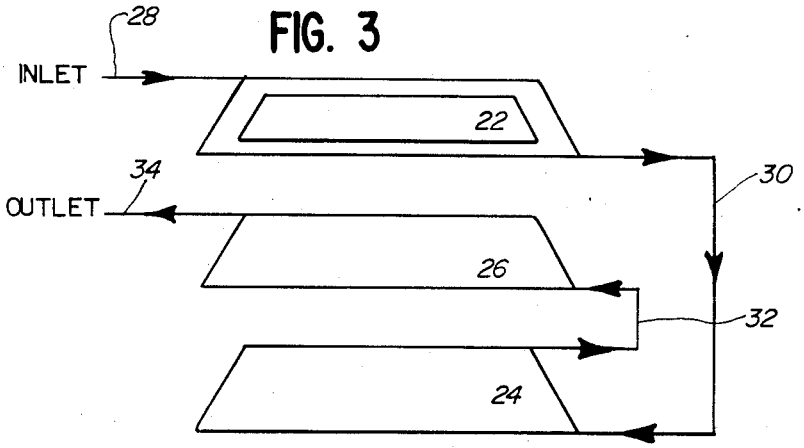
FIG. 3 is a schematic diagram of flow through the coil bank or heat exchanger of the present invention.

Fluid flow through countertemp heat exchanger 20 is schematically illustrated in FIG. 3 and can be compared to the flow in the prior or counter flow heat exchanger 110 illustrated in the left hand portion of FIG. 2. In the counter flow circuit 100, cold water is introduced first to the outer coils 118. Similarly, cold water is first directed to the outer coil 22 in the present invention. In the counter flow circuit 100, water flowing from the outer coils 118 is directed to the intermediate coils 116. Conversely, in the present invention, flow is directed from the outer coils 22 to the inner coils 24 and then to the intermediate coils 26. In the counter flow boiler 100, fluid flows from intermediate coils 116 to inner coils 114.

Flow of fluid through countertemp heat exchanger 20 places the highest fluid temperature near the highest flue gas temperature. The highest flue gas temperature exists in the area 18. Consequently, inner coils 24 are exposed to the highest flue gas temperature. The temperature of flue gas decreases as it passes through the intermediate coils 26 and outer coils 22. The flow of fluid illustrated in the right hand portion of FIG. 2 and in FIG. 3 results in a higher mean temperature difference throughout the heat exchanger 20 resulting in a higher heat extraction from the flue gas increasing the efficiency of boiler 10.

Figure 7:
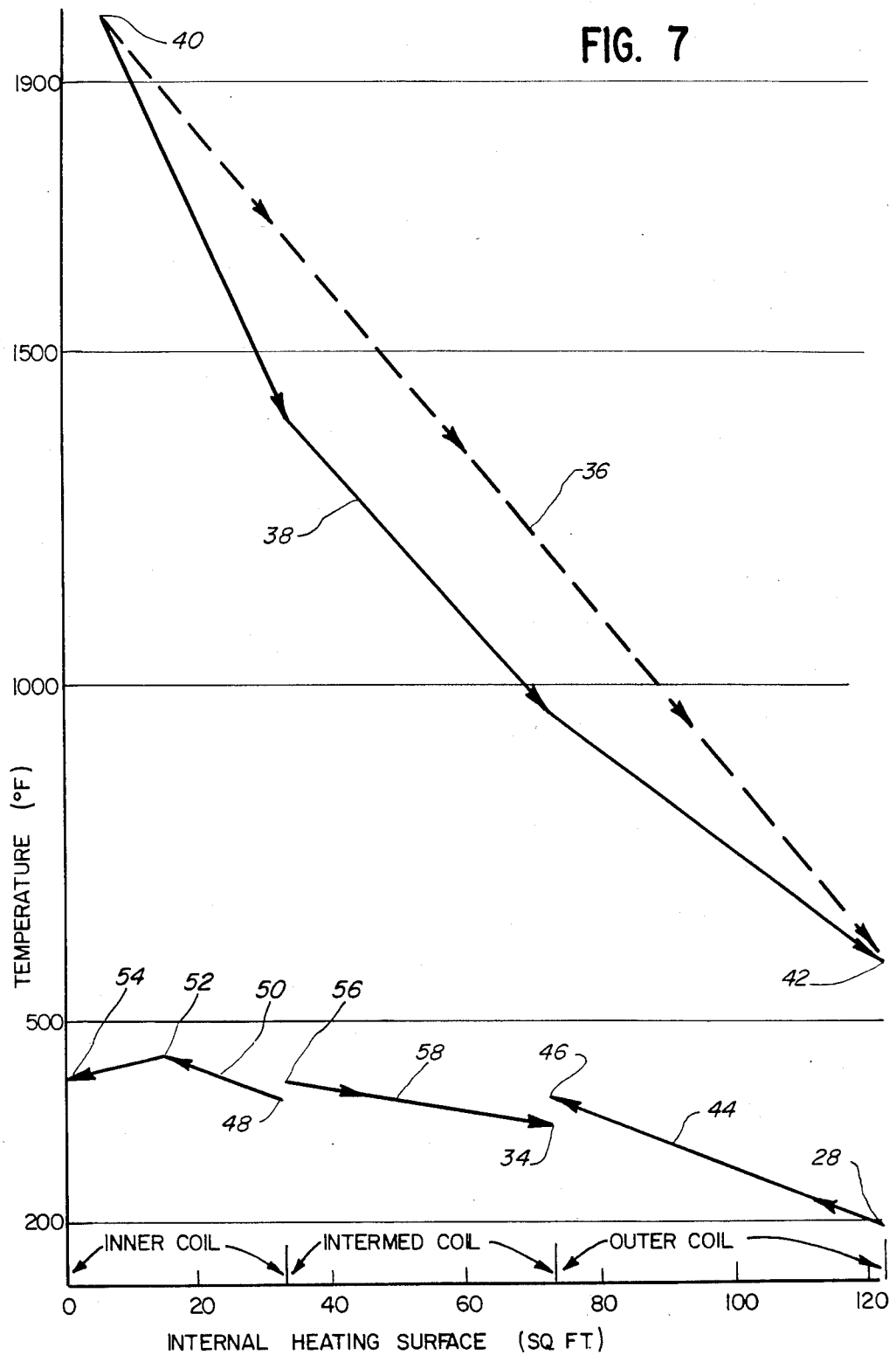
FIG. 7 is a graph similar to FIG. 6 plotting ideal flue gas temperature relative to flue gas temperature in a boiler constructed in accordance with the coil fluid flow principles of the present invention.

For a graphic illustration of this increased efficiency reference is made to FIG. 7. In the upper portion of FIG. 7 the flue gas profiles are plotted with the ideal flue gas designated by reference numeral 36 and the actual flue gas temperature through the heat exchanger 20 plotted on line 38. The maximum temperature of the flue gas for both lines 36 and 38 is designated by the point 40 and the minimum temperature is designated by the point 42. The deviation between lines 36 and 38 is much less than the deviation between lines 134 and 136 in FIG. 6 indicating increased efficiency by boiler 10.

The lower portion of FIG. 7 illustrates the temperature of fluid as it passes through coils 22, 24, and 26 of heat exchanger 20. Inlet 28 is indicated on this graph as is outlet 34. Line 44 plots the fluid temperature through outer coil 22. Point 46 on line 44 is physically connected to point 48 by the conduit or similar structure 30. Line 50 corresponds to the temperature of the water flowing through the inner coil 24. Point 52 on line 50 corresponds to the phase change of fluid flowing through heat exchanger 20. At point 52, water in heat exchanger 20 is going through a phase change into steam. The point 54 on line 50 is physically connected to point 56 on line 58 by the conduit or similar structure 32. Line 58 plots the temperature of fluid flowing through the intermediate coil to outlet 34. As indicated, there is a higher mean temperature difference throughout the heat exchanger 20 than that illustrated in the lower portion of FIG. 6. Also as shown in FIG. 2*a*, coils 26 are larger in diameter than the prior construction, increasing the Reynolds number for gas flow through the coil bank, thereby increasing heat transfer, without a corresponding increase in boiler combustion air blower horsepower requirements.

An additional advantage provided in countertemp heat exchanger 20 is that it is multisectioned. To limit the high pressure drop of fluid passing through heat exchanger 20 due to boiling, the heat exchanger flow area is increased after the point at which boiling begins. The larger diameter tubes of heat exchanger 20 are placed in the middle of the flow circuit at the point corresponding to point 52 in FIG. 7. In addition, flue gas temperature for the same velocity increases because heat transfer is a function of the Reynolds number and this Reynolds number increases linearly with the coil tubing diameter increase. This permits an increase in flue gas heat transfer without increasing the overall heat exchanger flue gas pressure drop.

To increase the efficiency of boiler 10 even further and to decrease the deviation from the ideal flue gas temperature line illustrated in FIG. 7, coils 22, 24, and 26 of countertemp heat exchanger 20 require an increase in gas side absorption capability. In the present invention an increase in absorption capability is accomplished in the same volumetric space as in typical heat exchangers without appreciably increasing flue gas pressure drop. An extended surface 60 on coils 22, 24 and 26 is provided to increase absorption capability.

Figure 4:
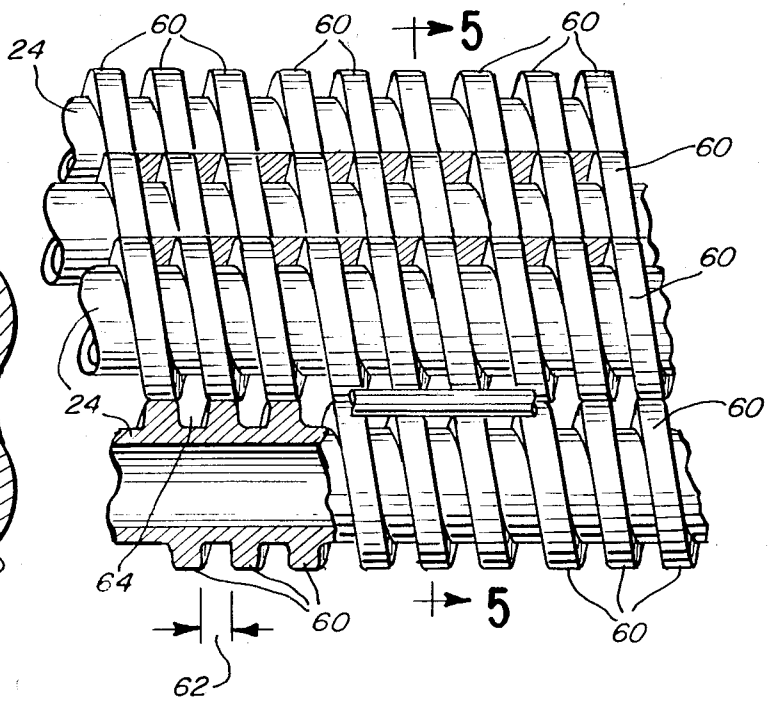
FIG. 4 is a partially cut-away pictorial view of a section of coils constructed in accordance with the principles of the present invention stacked on each other, each with an extended surface.
Figure 5:
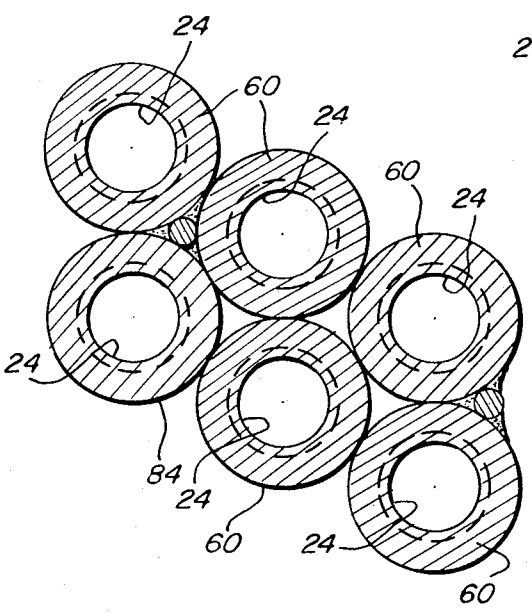
FIG. 5 is view taken along line 5—5 of FIG. 4.

With specific reference to coils 24, for example, reference is made to FIGS. 4 and 5. Extended surface 60 on coils 24 is a low profile finned surface most closely comparable to a multiple pitch acme thread. The extended surface 60 may be brazed to, welded to or integral with coil 24 and is of sufficient structural strength to replace sinusoidal spacers such as spacers 112 when wound in counter helical configuration. Surface 60 also extends the outer heating surface of coils 24 so that the heating capability will approach the inside wetted surface capability of coils 22, 24, and 26.

Adequate space 62 is provided between adjacent extended surfaces 60 to define spaces 64 through which flue gas may pass. Spacers 64 result upon helically winding coils 24 on top of each other. A sufficient winding angle or pitch of the substantially helical surfaces 60 is provided such that as the coils 24 are stacked on each other the extended surfaces 60 engage supporting each other without meshing. The extended surface 60 is in fact configured in a multiple pitch configuration since the outer windings of coils 24 are of a greater radius and require a variable pitch and width to ensure abutment of adjacent surfaces 60 and to define the open spaces or flue gas passages 64.

Figure 8:
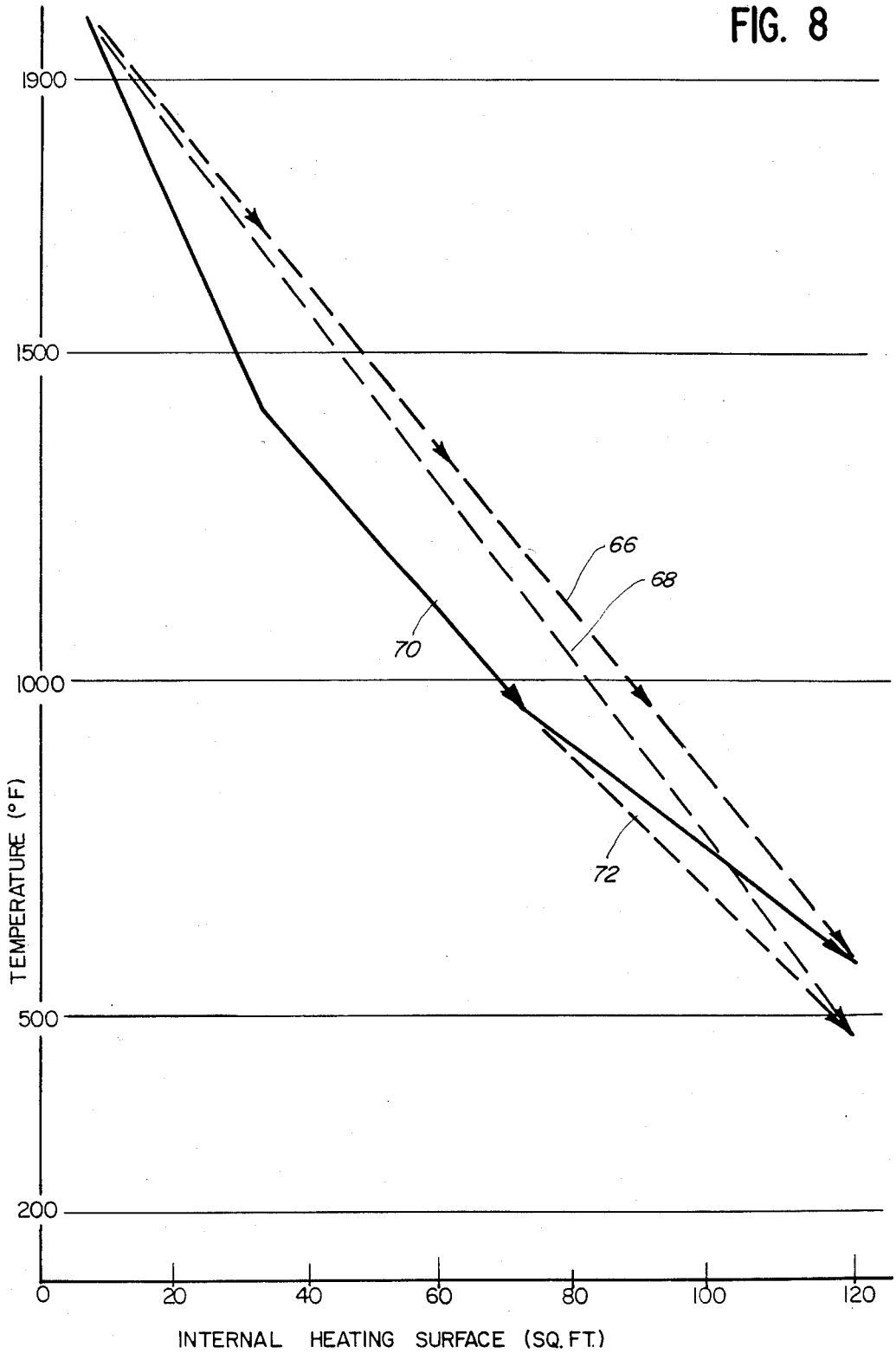
FIG. 8 is a graph similar to FIG. 7 plotting ideal flue gas relative to plots of actual conditions of a boiler with the flow scheme and with the extended coil surface of the present invention.

A comparison of the flue gas temperatures for a heat exchanger with the extended surface 60 is illustrated in FIG. 8. Line 66 in FIG. 8 corresponds to a plot of ideal flue gas temperature of a coil bank or heat exchanger without extended surfaces 60. Line 68 corresponds to a plot of ideal flue gas temperatures with extended surfaces 60 on the coils of exchanger 20. Solid line 70 corresponds to the actual flue gas temperatures of the coil bank or exchanger 20 without extended surfaces 60 and the dotted extension 72 of line 70 corresponds to the actual flue gas temperature with coils including the extended surface 60. As can be determined, greater absorption and efficiency is provided by the extended surfaces 60.

Many modifications and variations to the present invention are possible in light of the above teachings. Thus, it is to be understood that, within the scope of the appended claims, the invention may be practiced other than as specifically described.

What is claimed and sought to be secured by Letters Patent of the United States is:

1. A method of improving boiler efficiency wherein said boiler includes a casing, a heating chamber defined in said casing, a flue in communication with said heating chamber, a bank of coils connected in series surrounding said heating chamber concentric with a vertical axis extending through said boiler, said bank of coils including an inner coil surrounding said heating chamber, an intermediate coil surrounding said inner coil, and an outer coil surrounding said intermediate coil, the method comprising the steps of:

introducing fluid into said outer coil, communicating said fluid from said outer coil to said inner coil, communicating said fluid from said inner coil to said intermediate coil, and communicating said fluid from said intermediate coil to an outlet.

2. The method set forth in claim 1 further comprising the step of heating said fluid to a sufficient temperature in said inner coil to cause said fluid to vaporize to steam.

3. The method set forth in claim 1 further comprising the step of extending the surface of at least a portion of at least one of said inner, intermediate and outer coils by providing a fin on the outer periphery of at least one of said inner, intermediate and outer coils in the configuration of a helical thread of multiple pitch.

4. The method set forth in claim 1, further comprising the steps of:

forming said inner coils of a larger diameter than said outer coils, and forming said intermediate coils of a larger diameter than said inner coils.

5. A method of increasing the heat absorption capability of a heat exchanger for a boiler including a combustion chamber, comprising the steps of;

providing an elongated tube;

extending the outer peripheral surface of said tube, and forming the extended surface as a helical, multiple pitch screw thread; and coiling said tube to define an inner coil surrounding said combustion chamber, to define an intermediate coil surrounding said inner coil, to define an outer coil surrounding said intermediate coil;

communicating a source of fluid with said outer coil;

communicating said inner coil with said outer coil;

communicating said outer coil with said intermediate coil; and communicating said intermediate coil with an outlet.

6. The method set forth in claim 5, further comprising the steps of:

forming said inner coil of a larger diameter than said outer coil; and forming said intermediate coil of a larger diameter than said inner coil.

7. In a boiler of the type including a combustion chamber, a heat exchanger surrounding said combustion chamber, said heat exchanger comprising:

elongated tubes, said tubes formed into an inner coil surrounding said combustion chamber, an intermediate coil surrounding said inner coil, and an outer coil surrounding said intermediate coil, said outer coil including an inlet in communication with a source of fluid, said inner coil in series communication with said outer coil, said intermediate coil in series communication with said inner coil and with an outlet, said inner coil of a larger diameter than the diameter of said outer coil, said intermediate coil of a larger diameter than said inner coil;

at least a portion of each said inner, intermediate and outer coils includes an extended surface of a predetermined width.

8. The heat exchanger claimed in claim 7 wherein said extended surface is a fin in a helical configuration of multiple pitch, said width of said extended surface varying along the length of said inner, intermediate and outer coils.

* * * * *